US006135038A

United States Patent [19]

Okamoto

[11] Patent Number: 6,135,038

[45] Date of Patent: Oct. 24, 2000

[54] COMPUTER SEWING MACHINE AND METHOD OF CONTROLLING THE SAME

[75] Inventor: Hiroshi Okamoto, Moriguchi, Japan

[73] Assignee: Sewmaster Co., Ltd., Osaka, Japan

[21] Appl. No.: 09/344,242

[22] Filed: Jun. 25, 1999

[30] Foreign Application Priority Data

Jun. 4, 1999 [JP] Japan ..... 11-158785

[51] Int. Cl.[7] ..... D05B 19/12; D05B 21/00

[52] U.S. Cl. ..... 112/102.5; 112/470.04; 112/475.05; 700/138

[58] Field of Search ..... 112/102.5, 470.04, 112/470.06, 470.01, 475.05, 475.19, 456, 457; 700/138

[56] References Cited

U.S. PATENT DOCUMENTS

| | | | |
|---|---|---|---|
| 5,231,941 | 8/1993 | Wakayama | 112/103 X |
| 5,284,104 | 2/1994 | Hori et al. | 112/102.5 |
| 5,313,896 | 5/1994 | Hashiride | 112/103 X |
| 5,662,055 | 9/1997 | Hartwig et al. | 112/470.04 |

FOREIGN PATENT DOCUMENTS

| | | |
|---|---|---|
| 01291892A | 11/1989 | Japan . |
| 02080084A | 3/1990 | Japan . |
| 03113061A | 5/1991 | Japan . |
| 06114174A | 4/1994 | Japan . |
| 07194880A | 8/1995 | Japan . |
| 10328448A | 12/1998 | Japan . |
| 11076663A | 3/1999 | Japan . |

*Primary Examiner*—Peter Nerbun
*Attorney, Agent, or Firm*—Armstrong, Westerman, Hattori, McLeland & Naughton

[57] ABSTRACT

A high-functional computer sewing machine can be obtained at a low cost. The inventive computer sewing machine comprises a data signal input/output part and a control part. The data signal input/output part transmits/receives a data signal to/from an externally set data input/output unit by data communication through any of a transmission line, radio and light. The control part controls the operation of a sewing machine body on the basis of the data signal from the data input/output unit received by the data signal input/output part. Thus, when using a commercially available game machine or the like as the data input/output unit, no data input/output unit dedicated to the sewing machine need be separately purchased while the sewing machine body need not be provided with a high-priced liquid crystal touch panel for inputting data.

7 Claims, 16 Drawing Sheets

COMPUTER SEWING MACHINE AND METHOD OF CONTROLLING THE SAME

BACKGROUND OF THE INVENTION

1. Field of the Invention

The present invention relates to a computer sewing machine and a method of controlling the same, and more particularly, it relates to a computer sewing machine having a built-in microcomputer and a method of controlling the same.

2. Description of the Prior Art

A computer sewing machine enabled for various types of pattern sewing and embroidering with a ROM card or the like storing sewing patterns is recently known as one of computer sewing machines having built-in microcomputers. FIG. 27 is a block diagram showing the overall structure of such a conventional computer sewing machine.

Referring to FIG. 27, a sewing machine microcomputer 111, a needle position control stepping motor 116 and a driver 114 therefor, a feed regulating stepping motor 117 and a driver 115 therefor and a sewing machine driving main motor 118 are built in a body 110 of the conventional sewing machine.

The sewing machine microcomputer 111 is connected with the drivers 114 and 115, which are connected with the needle position control stepping motor 116 and the feed regulating stepping motor 117 respectively. The sewing machine microcomputer 111 is also connected with the sewing machine driving main motor 118. The sewing machine body 110 is provided with a liquid crystal touch panel 119, which is connected with the sewing machine microcomputer 111, for inputting sewing pattern data for the computer sewing machine. The sewing machine body 110 is further provided with a switch 112 such as a power switch or a start switch and a sensor 113 such as that for detecting that a bobbin thread is being taken up. The switch 112 and the sensor 113 are connected with the sewing machine microcomputer 111.

An embroiderer part 130 is detachably set in the sewing machine body 110. An X-directional stepping motor 133 and a driver 131 therefor as well as a Y-directional stepping motor 134 and a driver 132 therefor are set in the embroiderer part 130. The sewing machine microcomputer 111 is connected with the drivers 131 and 132, which are connected with the X-directional stepping motor 133 and the Y-directional stepping motor 134 respectively.

The sewing machine body 110 is provided on its outer surface with a slit (not shown) for inserting a ROM card 120 storing sewing patterns in a connector mounted on a control board.

In order to operate the conventional computer sewing machine shown in FIG. 27, the ROM card 120 storing sewing patterns is set in the slit of the sewing machine body 110.

In this state, prescribed portions of the surface of the liquid crystal touch panel 119 provided on the outer surface of the sewing machine body 110 are sequentially pressed in accordance with instructions on the screen of the liquid crystal touch panel 119, thereby specifying a sewing pattern. A start switch (not shown) provided on the outer surface of the sewing machine body 110 is turned on thereby starting the computer sewing machine and executing the specified sewing pattern.

In order to sew or embroider a pattern other than those stored in the ROM card 12, a dedicated data writing unit 121 including a scanner is employed. More specifically, a sewing pattern described on a prescribed sheet is read with the scanner of the data writing unit 121. The read sewing pattern is written in a writable ROM card with the data writing unit 121. Alternatively, sewing pattern data read from a personal computer 122 may be written in a writable ROM card with the data writing unit 121.

In the aforementioned conventional computer sewing machine, however, the high-priced liquid crystal touch panel 119 for inputting data is provided on the outer surface of the sewing machine body 110. Thus, the cost for the sewing machine body 110 is so extremely increased that the computer sewing machine is hard to purchase for a general consumer.

In order to sew or embroider a pattern other than those stored in the ROM card 120, further, the dedicated data writing unit 121 for writing the data of the pattern in a writable ROM card is newly required.

SUMMARY OF THE INVENTION

An object of the present invention is to provide a high-functional computer sewing machine at a low cost.

Another object of the present invention is to provide a computer sewing machine readily enabled for sewing or embroidering a pattern other than previously stored ones with no requirement for a dedicated writing unit.

Still another object of the present invention is to provide a method of controlling a computer sewing machine capable of reducing the cost for manufacturing a sewing machine body.

A computer sewing machine according to an aspect of the present invention comprises a data signal input/output part and a control part. The data signal input/output part transmits/receives a data signal to/from an externally set data input/output unit by data communication employing any of a transmission line, radio and light. The control part controls the operation of a sewing machine body on the basis of the data signal from the data input/output unit received by the data signal input/output part. In the computer sewing machine according to this aspect of the present invention, the operation of the sewing machine body is thus set through the externally set data input/output unit. When employing a commercially available game machine or the like as the data input/output unit, therefore, no data input/output unit dedicated to the sewing machine need be separately purchased while the sewing machine body need not be provided with a high-priced liquid crystal touch panel for inputting data. Thus, the cost for manufacturing the sewing machine body can be reduced, and a high-functional computer sewing machine can be consequently provided at a low cost.

In the structure of the computer sewing machine according to the aforementioned aspect of the present invention, the data input/output unit may include a portable game machine integrally formed with an operation part and a display panel. When employing such a portable game machine having a display panel and an operation part as the data input/output unit, no data input/output unit dedicated to the sewing machine need be separately purchased while the sewing machine body need not be provided with a high-priced liquid crystal touch panel for inputting data. Thus, the cost for manufacturing the sewing machine body can be reduced, and a high-functional computer sewing machine can be consequently provided at a low cost. In this structure, further, the portable game machine may include a storage medium storing a program for operating the sewing machine body. According to this structure, the portable game machine can be readily utilized as the data input/output unit for the computer sewing machine by setting the storage medium on the portable game machine. In this structure, the sewing machine body may include a game machine mounting part for mounting the portable game machine. According to this structure, the portable game machine is mounted on the game machine mounting part so that data can be readily input as compared with the case of manually holding the portable game machine and inputting data, whereby the workability of data input can be improved. Further, it is possible to effectively prevent the portable game machine from falling, which may be caused when inputting data while manually holding the portable game machine.

In the structure of the computer sewing machine according to the aforementioned aspect of the present invention, the data input/output unit may include a television game machine employing the screen of a television as a display panel. When employing such a television game machine as the data input/output unit, no data input/output unit dedicated to the sewing machine may be separately purchased while the sewing machine body may not be provided with a high-priced liquid crystal touch panel for inputting data. Thus, the cost for manufacturing the sewing machine body can be reduced, and a high-functional computer sewing machine can be consequently provided at a low cost. In this structure, further, the television game machine may include a storage medium storing a program for operating the sewing machine body. Thus, the television game machine can be readily utilized as the data input/output unit for the computer sewing machine by setting the storage medium on the television game machine.

In the structure of the computer sewing machine according to the aforementioned aspect of the present invention, the data input/output unit preferably includes a personal computer having a display. When transferring an embroidery pattern created in the personal computer or a pattern downloaded in the personal computer through Internet to the sewing machine body through data communication, a pattern other than previously stored ones can be readily sewn or embroidered with no requirement for a writing unit dedicated to the sewing machine dissimilarly to the prior art. When employing such a personal as the data input/output unit, no data input/output unit dedicated to the sewing machine need be separately purchased while the sewing machine body need not be provided with a high-priced liquid crystal touch panel for inputting data. Thus, the cost for manufacturing the sewing machine body can be reduced, and a high-functional computer sewing machine can be consequently provided at a low cost.

In this structure, the personal computer preferably includes a storage medium storing a program for operating the sewing machine body. When setting the storage medium on the personal computer, the personal computer can be readily utilized as the data input/output unit for the computer sewing machine.

In any of the aforementioned structures, the sewing machine body may include an embroiderer unit, attachable/detachable to/from the sewing machine body, for performing embroidering. Due to this structure, embroidering can be readily performed by simply attaching the embroiderer unit to the sewing machine body.

A method of controlling a computer sewing machine according to another aspect of the present invention comprises steps of inputting operation data for a sewing machine body in an externally set data input/output unit, transmitting the input operation data from the data input/output unit to the sewing machine body by data communication by means of any of a transmission line, radio and light, and controlling an operation of the sewing machine body on the basis of the operation data transmitted to the sewing machine body. Thus, the operation of the sewing machine body is set through the externally set data input/output unit, whereby no data input/output unit dedicated to the sewing machine may be separately purchased while the sewing machine body may not be provided with a high-priced liquid crystal touch panel for inputting data when employing a commercially available game machine or the like as the data input/output unit. Consequently, a method of controlling a computer sewing machine capable of reducing the cost for manufacturing the sewing machine body can be provided.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Before describing embodiments of the present invention, the concept of the present invention is described with reference to drawings.

Figure 1:
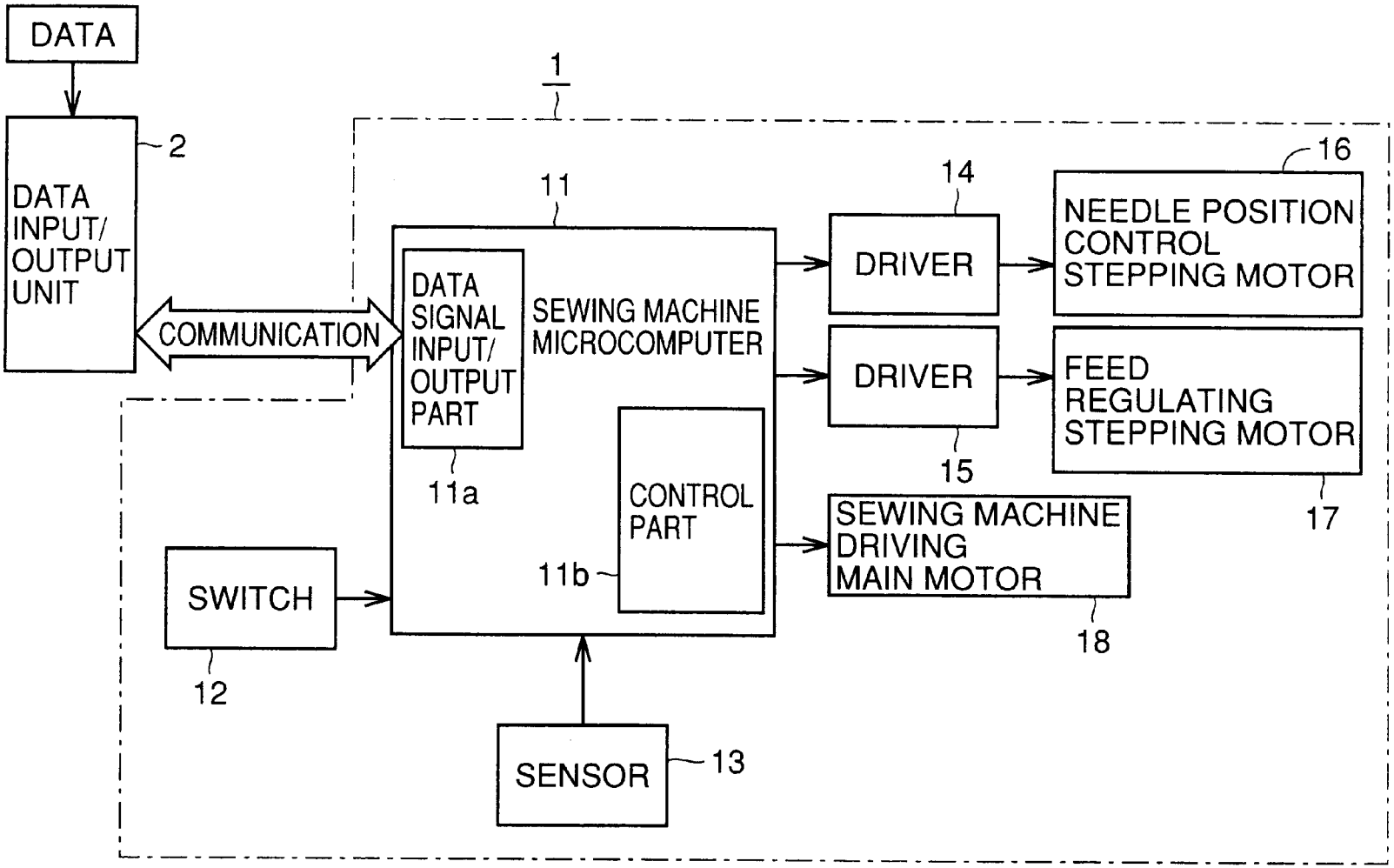
FIG. 1 is a block diagram for illustrating the concept of a computer sewing machine according to the present invention, to which no embroiderer unit is attached.

Referring to FIG. 1, a sewing machine microcomputer 11, a needle position control stepping motor 16 and a driver 14 therefor, a feed regulating stepping motor 17 and a driver 15 therefor and a sewing machine driving main motor 18 are built in a body 1 of a computer sewing machine according to the present invention, to which no embroiderer unit is attached.

The sewing machine microcomputer 11 is connected with the drivers 14 and 15, which are connected with the needle position control stepping motor 16 and the feed regulating stepping motor 17 respectively. The sewing machine microcomputer 11 is also connected with the sewing machine driving main motor 18. The sewing machine body 1 is provided with a switch 12 such as a power switch or a start switch and a sensor 13 for detecting that a bobbin thread is being taken up. The switch 12 and the sensor 13 are connected with the sewing machine microcomputer 11.

The sewing machine microcomputer 11 includes a data signal input/output part 11*a* and a control part 11*b*. The data signal input/output part 11*a* transmits/receives a data signal to/from an externally set data input/output unit 2 through data communication employing any of a transmission line, radio and light. The control part 11*b* controls the operation of the sewing machine body 1 on the basis of the data signal from the data input/output unit 2 received by the data signal input/output part 11*a*.

In order to operate the computer sewing machine according to the present invention, the externally set data input/output unit 2 and the sewing machine body 1 are first enabled for communication by means of a transmission line, radio or light. In this state, a sewing pattern is specified through an operation part (not shown) of the data input/output unit 2 in accordance with an instruction on the screen of a display part (not shown) of the data input/output unit 2. The specified sewing pattern data is transferred to the data signal input/output part 11*a* of the sewing machine body 1 through data communication. The control part 11*b* controls the sewing machine body 1 on the basis of the sewing pattern data received in the data signal input/output part 11*a*, to create the specified sewing pattern.

Figure 27:
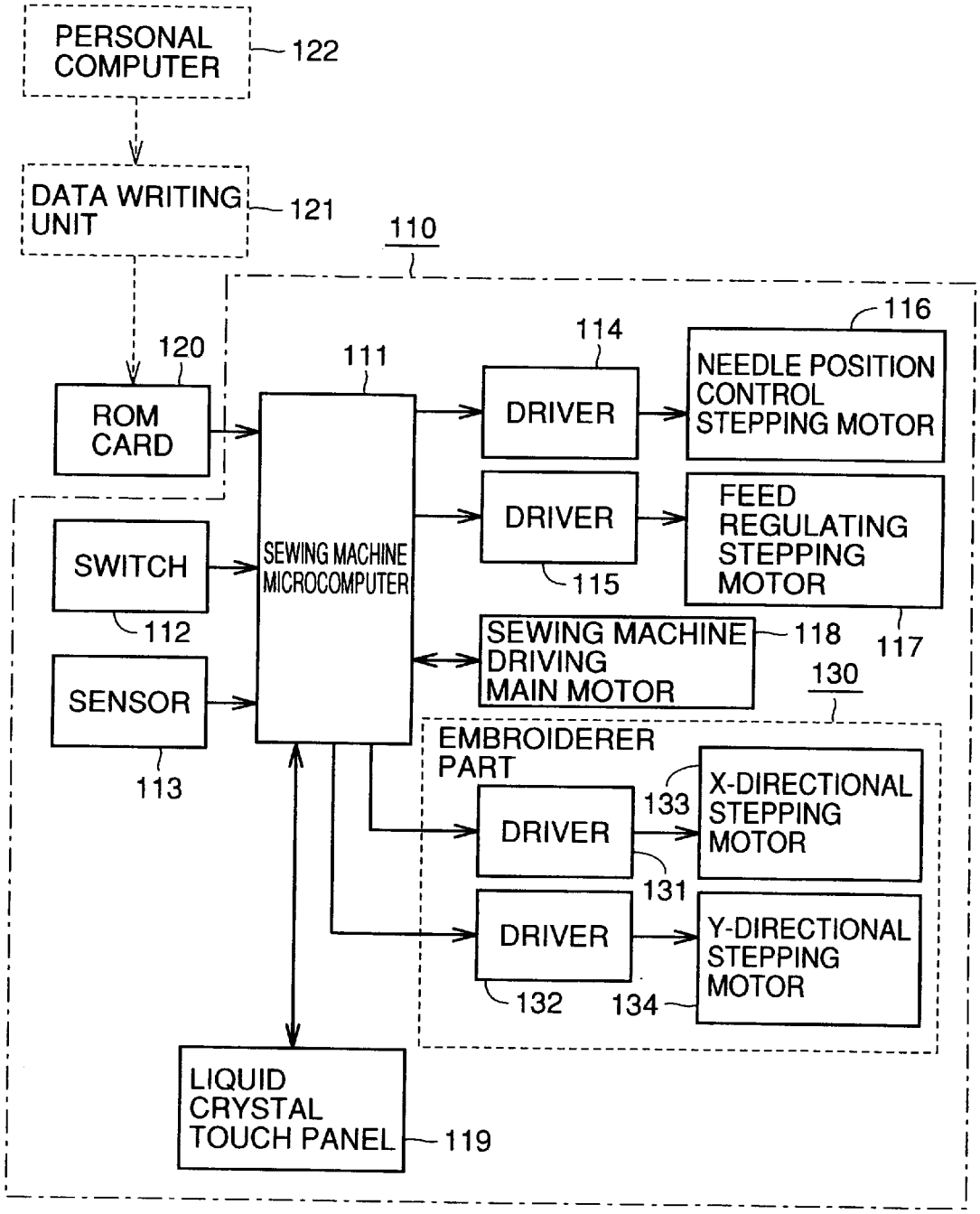
FIG.27 PRIOR ART
FIG. 27 is a block diagram showing the overall structure of a conventional computer sewing machine.

In the computer sewing machine according to the present invention, the operation of the sewing machine body 1 is set through the externally set data input/output unit 2. When employing a commercially available game machine, for example, as the data input/output unit 2, therefore, no data input/output unit 2 dedicated to the sewing machine need be separately purchased while the sewing machine body 1 need not be provided with the high-priced liquid crystal touch panel 119 (see FIG. 27) dissimilarly to the prior art. Thus, the cost for manufacturing the sewing machine body 1 can be reduced, and a high-functional computer sewing machine can be consequently provided at a low cost.

Figure 2:
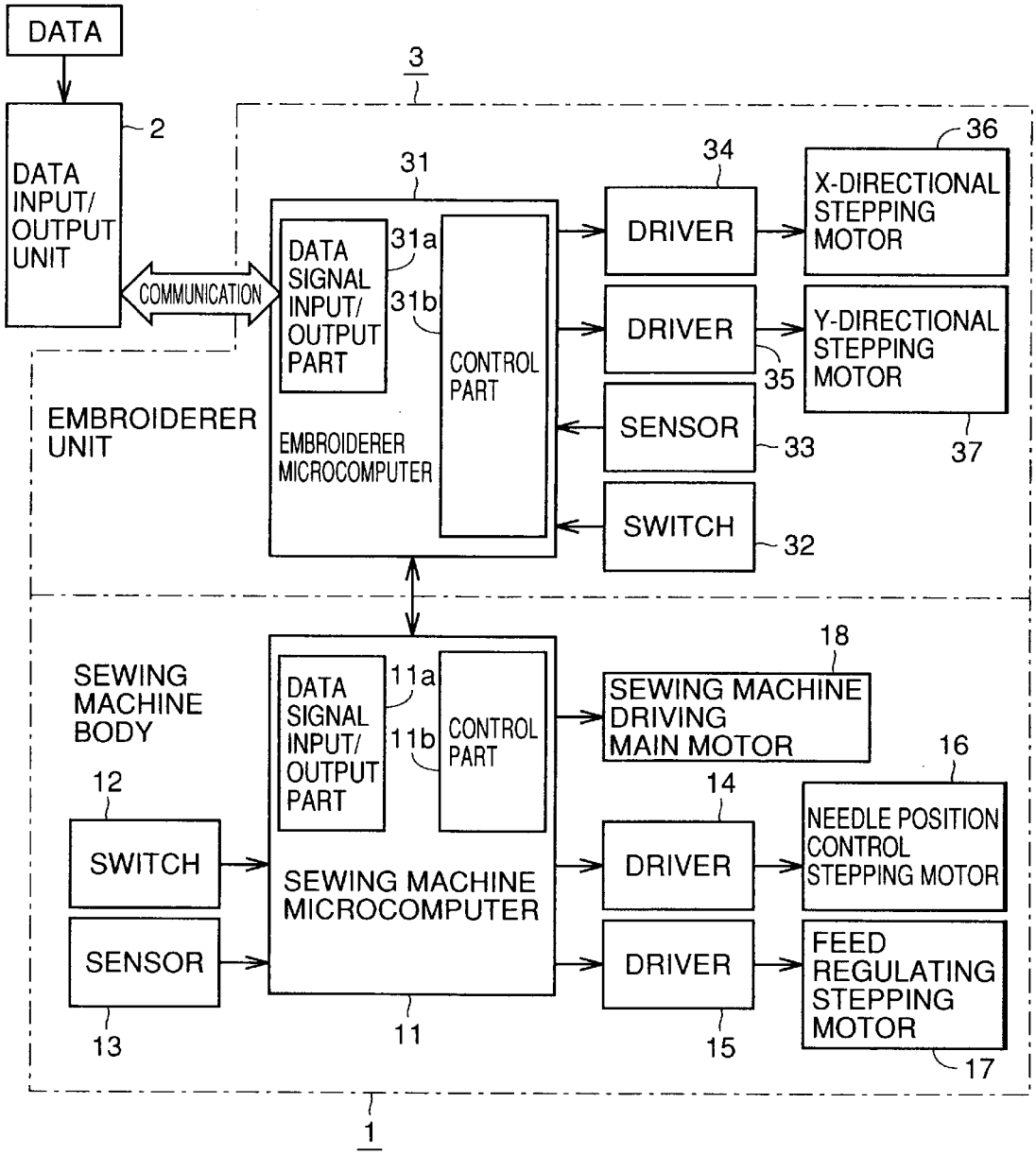
FIG. 2 is a block diagram for illustrating the concept of the computer sewing machine according to the present invention, to which an embroiderer unit is attached.

Referring to FIG. 2, an embroiderer unit 3 is detachably set on the sewing machine 1 in the computer sewing machine according to the present invention. An embroiderer microcomputer 31, an X-directional stepping motor 36 and a driver 34 therefor and a Y-directional stepping motor 37 and a driver 35 therefor are built in the embroiderer unit 3. The embroiderer microcomputer 31 is connected with the drivers 34 and 35, which are connected with the X-directional stepping motor 36 and the Y-directional stepping motor 37 respectively.

The embroiderer unit 3 is provided with a switch 32 such as a power switch 32 and a sensor 33 for detecting the origins of the X-directional stepping motor 36 and the Y-directional stepping motor 37 or the like, and the switch 32 and the sensor 33 are connected with the embroiderer microcomputer 31. The embroiderer microcomputer 31 includes a data signal input/output part 31*a* and a control part 31*b*. The data signal input/output part 31a transmits/receives a data signal to/from the externally set data input/output unit 2 through data communication employing any of a transmission line, radio and light. The control part 31*b* controls the operation of the embroiderer unit 3 on the basis of the data signal from the data input/output unit 2 received by the data signal input/output part 31*a*. The embroiderer microcomputer 31 is connected with the sewing machine microcomputer 11.

When the embroiderer unit 3 is attached to the computer sewing machine, the externally set data input/output unit 2 and the embroiderer unit 3 are first enabled for communication by means of a transmission line, radio or light. In this state, an embroidery pattern is specified through the operation part (not shown) of the data input/output unit 2 in accordance with an instruction on the screen of the display part (not shown) of the data input/output unit 2. The specified embroidery pattern data is transferred to the data signal input/output part 31a of the embroiderer unit 3 through data communication.

The control part 31*b* of the embroiderer unit 3 drives/controls the X-directional stepping motor 36 and the Y-directional stepping motor 37 of the embroiderer unit 3 on the basis of the embroidery pattern data transferred to the data signal input/output part 31*a* from the data input/output unit 2. On the other hand, the control part 11*b* of the sewing machine body 1 holds the needle position control stepping motor 16 on a needle center position while holding the feed regulating stepping motor 17 on a zero feed position. In this state, the control part 11*b* of the sewing machine body 1 drives the sewing machine driving main motor 18.

Embodiments embodying the aforementioned concept of the present invention are now described with reference to drawings.

(First Embodiment)

Figure 3:
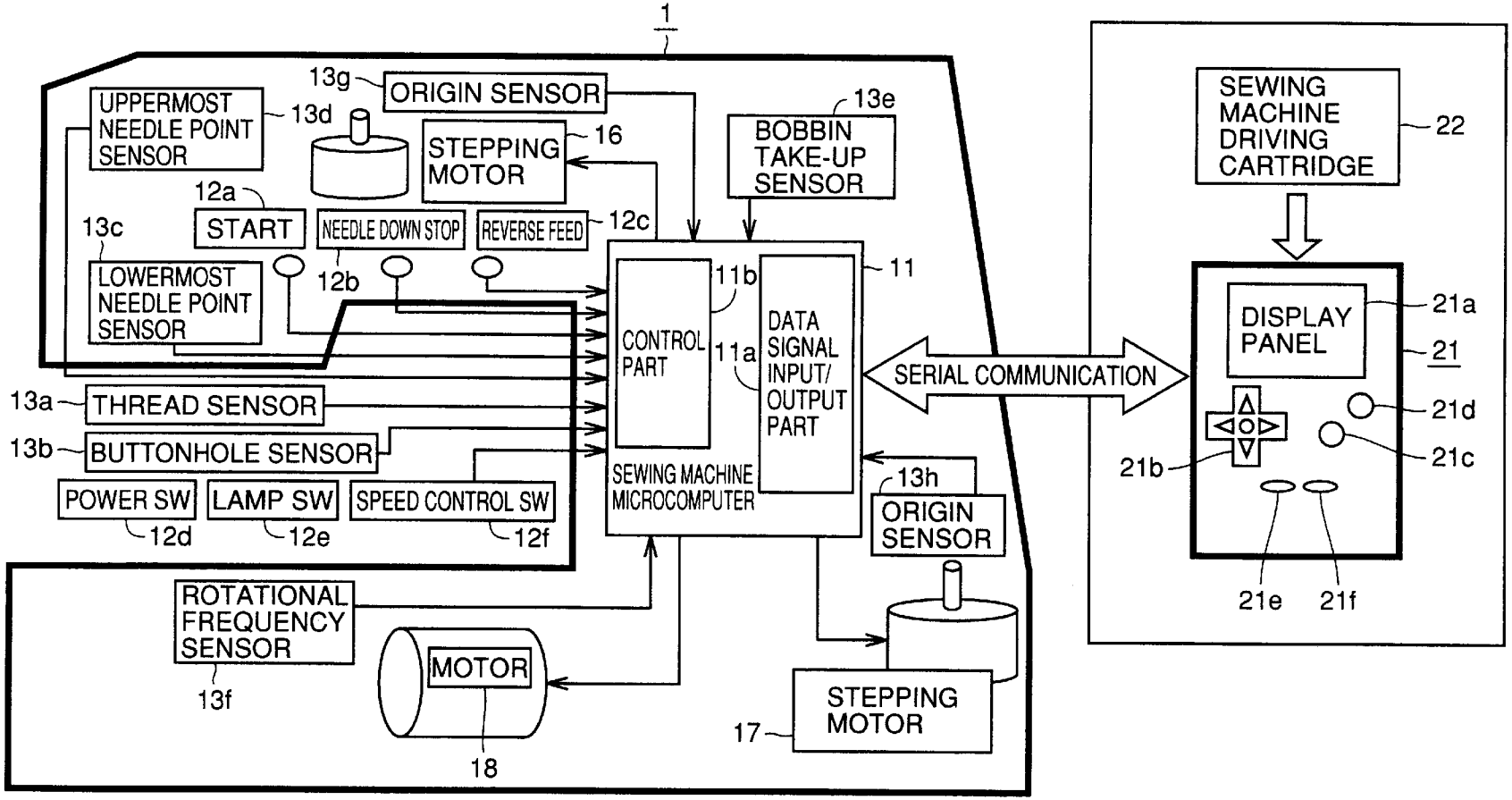
FIG. 3 is a schematic diagram showing the structure of a computer sewing machine according to a first embodiment of the present invention.

Referring to FIG. 3, a portable game machine 21 is employed as a data input/output unit in a computer sewing machine according to a first embodiment of the present invention.

More specifically, a sewing machine microcomputer 11, a needle position control stepping motor 16, a feed regulating stepping motor 17 and a sewing machine driving main motor 18 are built in a body 1 of the computer sewing machine according to the first embodiment. The sewing machine microcomputer 11 is connected with the needle position control stepping motor 16, the feed regulating stepping motor 17 and the sewing machine driving main motor 18.

Further, a start switch 12*a*, a needle down stop switch 12*b*, a reverse feed switch 12*c*, a power switch 12*e*, a lamp switch 12*e* and a speed control switch 12*f* are provided on the outer surface of the sewing machine body 1.

The sewing machine body 1 is further provided with a thread sensor 13*a*, a buttonhole sensor 13*b*, a lowermost needle point sensor 13*c*, an uppermost needle point sensor 13*d*, a take-up sensor 13*e*, a rotational frequency sensor 13*f*, an origin sensor 13*g* and another origin sensor 13*h*.

The thread sensor 13*a* senses breakage of the top thread, and the buttonhole sensor 13*b* senses start and turn positions for a buttonhole. The lowermost needle point sensor 13*c* senses the lowermost point of the needle, and the uppermost needle point sensor 13*d* senses the uppermost point of the needle.

The take-up sensor 13*e* senses that the bobbin thread is being taken up on a bobbin, and the rotational frequency sensor 13*f* senses the rotational frequency of the sewing machine driving main motor 18. The origin sensor 13*g* senses the origin of the needle position control stepping motor 16, and the origin sensor 13*h* senses the origin of the feed regulating stepping motor 17. The switches 12*a* to 12*f* and the sensors 13*a* to 13*h* are connected with the sewing machine microcomputer 11.

The sewing machine microcomputer 11 includes a data signal input/output part 11*a* and a control part 11*b*. The data signal input/output part 11*a* transmits/receives a serial signal to/from the externally set portable game machine 21. The control part 11*b* controls the operation of the sewing machine body 1 on the basis of the serial signal from the portable game machine 21 received in the data signal input/output part 11*a*.

The portable game machine 21 includes a display panel 21*a*, a cross switch 21*b*, an A button 21*d*, a B button 21*c*, an S button 21*e* and a start button 21*f*. The portable game machine 21 further includes a sewing machine driving cartridge 22 as a storage medium storing a program for operating the sewing machine body 1. The portable game machine 21 can be readily utilized as the data input/output unit for the computer sewing machine by setting the sewing machine driving cartridge 22 on the portable game machine 21.

In the computer sewing machine according to the first embodiment, data is input in the sewing machine body 1 through the externally set portable game machine 21, whereby no data input/output unit dedicated to the sewing machine need be separately purchased while the sewing machine body 1 need not be provided with the high-priced liquid crystal touch panel 119 (see FIG. 27) for inputting data dissimilarly to the prior art. Thus, the cost for manufacturing the sewing machine body 1 can be reduced, and a high-functional computer sewing machine can be consequently provided at a low cost.

Figure 4:
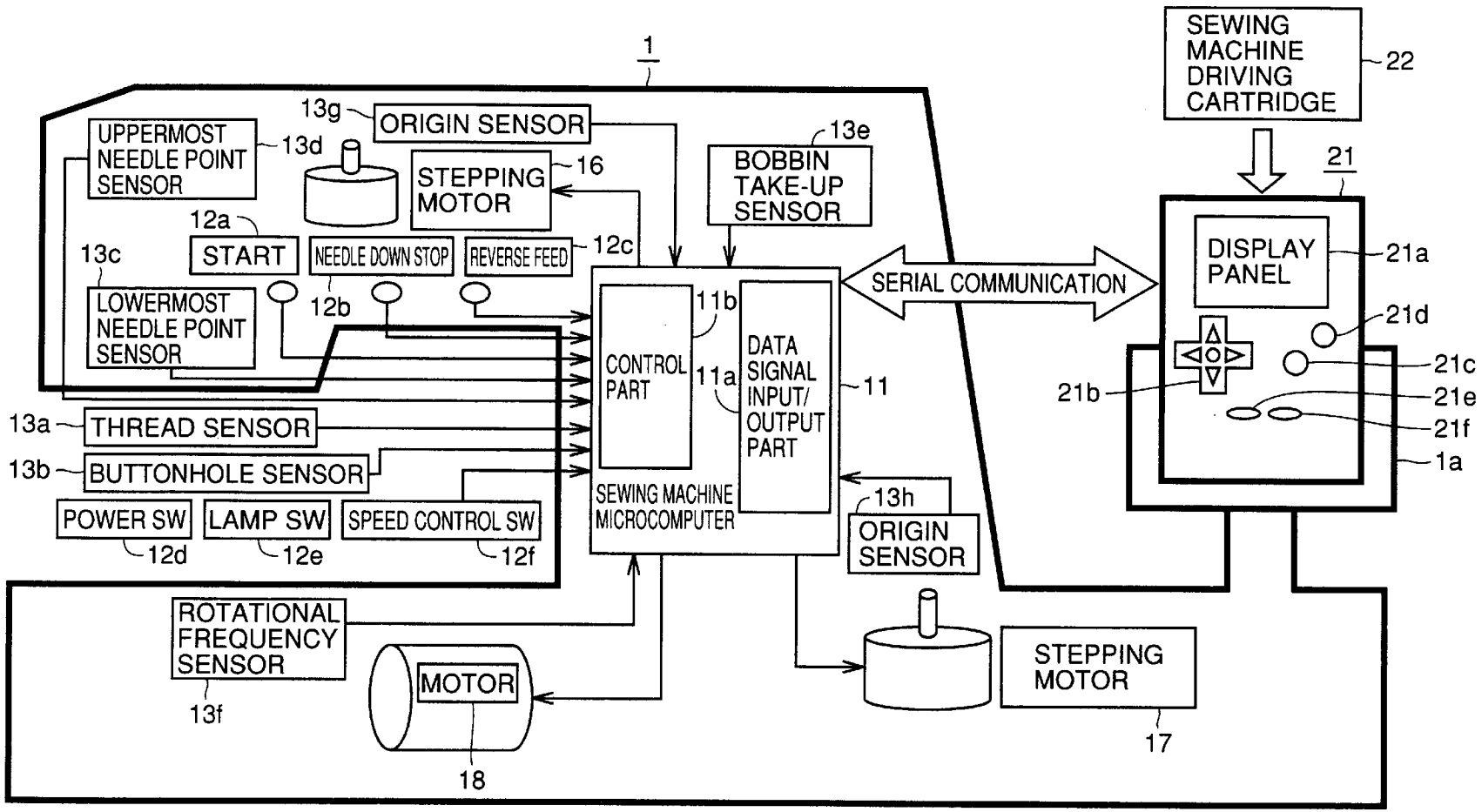
FIG. 4 is a schematic diagram showing the structure of a first modification of the computer sewing machine according to the first embodiment.

FIG. 4 is a schematic diagram showing the structure of a first modification of the computer sewing machine according to the first embodiment. Referring to FIG. 4, a stand 1*a* for mounting a portable game machine 21 is provided on a sewing machine body 1 in addition to the structure of the first embodiment shown in FIG. 3. The portable game machine 21 is mounted on the stand 1*a* for inputting data, whereby the data can be readily input as compared with the case of manually holding the portable game machine 21 and inputting data, whereby the workability of data input can be improved. Further, it is possible to effectively prevent the portable game machine 21 from falling, which may be caused when inputting data while manually holding the portable game machine 21.

Figure 5:
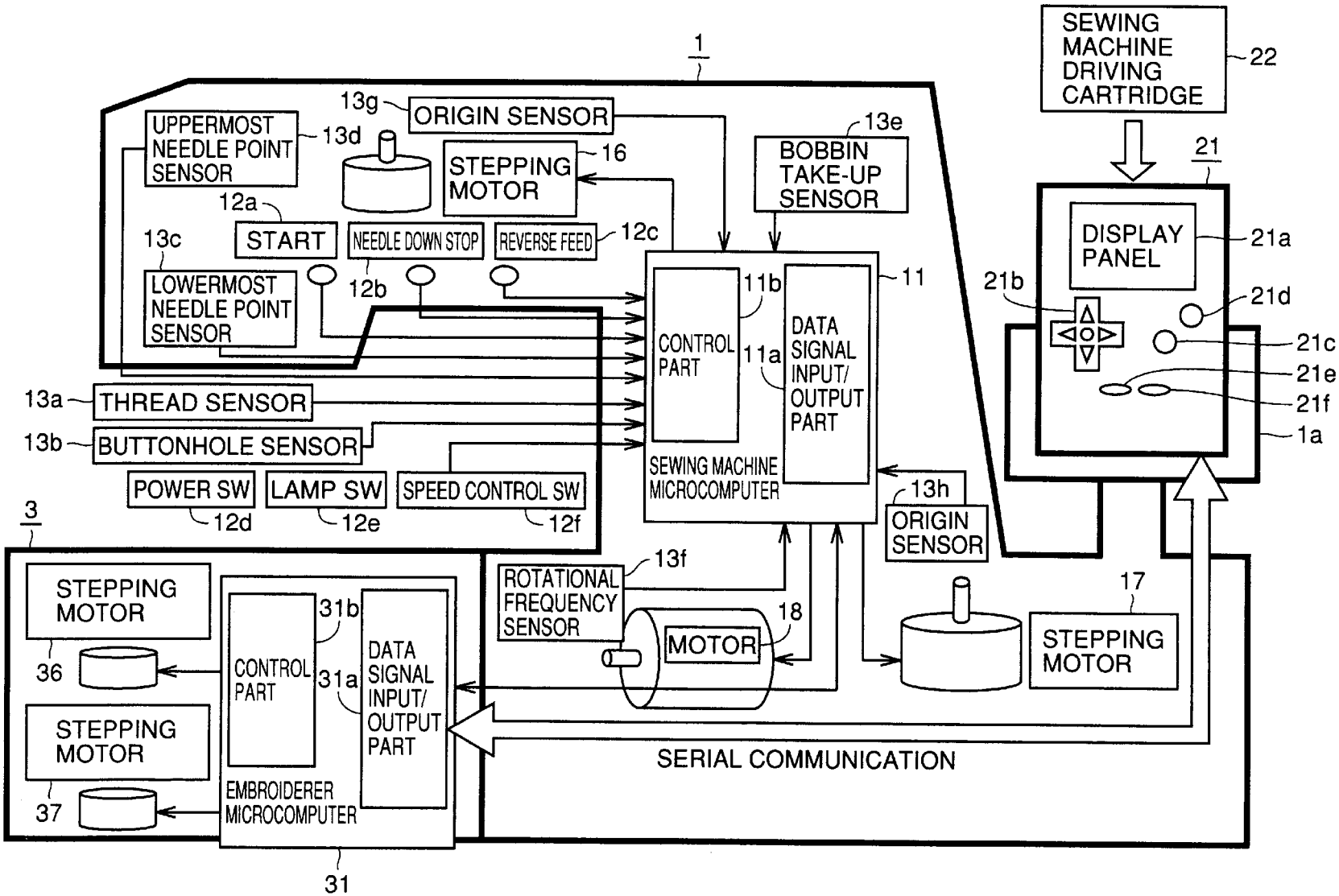
FIG. 5 is a schematic diagram showing the structure of a second modification of the computer sewing machine according to the first embodiment.

FIG. 5 is a schematic diagram showing the structure of a second modification of the computer sewing machine according to the first embodiment. Referring to FIG. 5, an embroiderer unit 3 is detachably set on a sewing machine body 1, in addition to the structure of the first modification of the embodiment 1 shown in FIG. 4. The embroiderer unit 3 is similar in structure to the embroiderer unit 3 shown in FIG. 3. An embroiderer microcomputer 31, an X-directional stepping motor 36 and a driver 34 therefor and a Y-directional stepping motor 37 and a driver 35 therefor are built in the embroiderer unit 3.

The embroiderer microcomputer 31 includes a data signal input/output part 31*a* and a control part 31*b*. The data signal input/output part 31*a* transmits/receives a signal to/from an externally set portable game machine 21. The control part 31*b* controls the operation of the embroiderer unit 3 on the basis of a serial signal from the portable game machine 21 received in the data signal input/output part 31*a*.

With reference to FIGS. 3 to 22, a method of inputting data in the computer sewing machine according to the first embodiment is now described.

Figure 6:
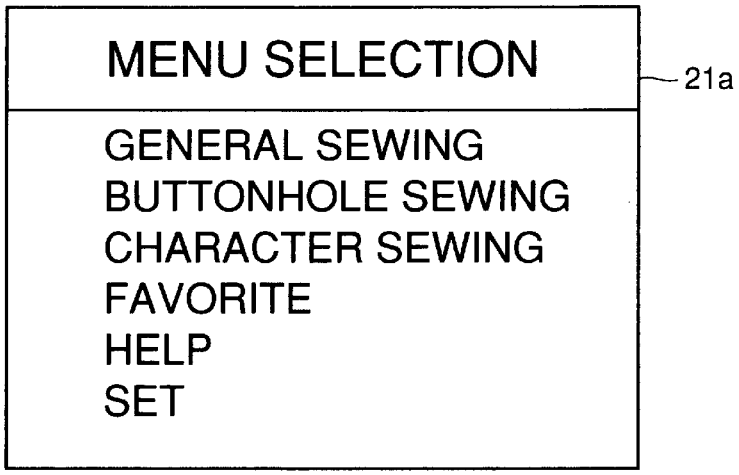
FIGS. 6 to 22 are schematic diagrams showing screens of a portable game machine in data input in the computer sewing machine according to the first embodiment.

As shown in FIGS. 3 to 5, the sewing machine driving cartridge 22 is set on the externally set portable game machine 21. The portable game machine 21 is connected with the sewing machine body 1 through a serial communication cable (not shown). In this state, the start button 21*f* of the portable game machine 21 is pressed so that an initial screen (menu select screen) shown in FIG. 6 is displayed on the display panel 21*a* of the portable game machine 21. The initial screen is for rough selection.

More specifically, one item is selected from "GENERAL SEWING", "BUTTONHOLE SEWING", "CHARACTER SEWING", "FAVORITE", "HELP" and "SET". When "GENERAL SEWING" is selected, the computer sewing machine executes practical seaming, elastic seaming or decorative stitching. When "BUTTONHOLE SEWING" is selected, the computer sewing machine executes buttonhole sewing. When "CHARACTER SEWING" is selected, the computer sewing machine embroiders alphabets, hiragana, katakana, kanji or numerals. In order to select "CHARACTER SEWING", the embroiderer unit 3 must be attached to the sewing machine body 1 as in the second modification shown in FIG. 5.

When "FAVORITE" is selected, the computer sewing machine sews a previously registered "FAVORITE" pattern. When "HELP" is selected, the operation manual can be read. When "SET" is selected, sound effect or the color of the screen can be selected.

Figure 7:
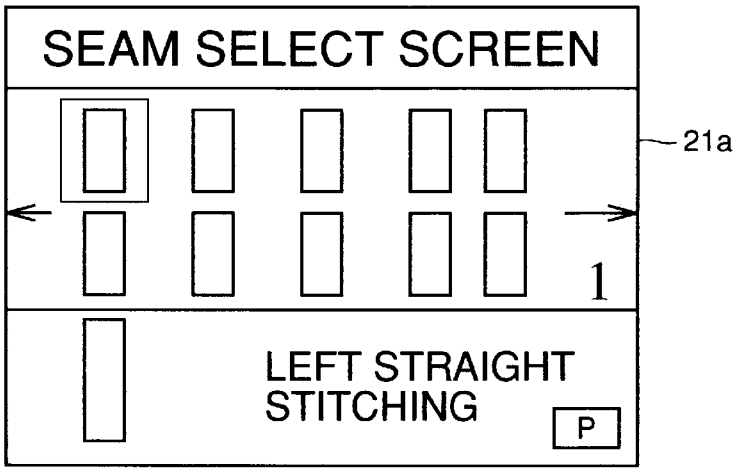

When "GENERAL SEWING" is selected on the initial screen shown in FIG. 6, for example, a seam select screen shown in FIG. 7 is displayed. The seam select screen displaying ten types of sewing patterns, for example, is scrolled by pressing the cross key 21*b* (see FIG. 3 or 4) of the portable game machine 21 leftward or rightward. The numeral "1" on the right side of the screen serves as an address. An arbitrary sewing pattern is selected from the ten types of sewing patterns through the A button 21*d* (see FIG. 3 or 4) of the portable game machine 21.

For example, left straight stitching is selected from practical seaming. "P" shown on the lower right portion of the screen shown in FIG. 7 indicates practical seaming, while "E" is displayed for elastic seaming and "D" is displayed for decorative stitching. When pressing the B button 21*c* (see FIG. 3 or 4) of the portable game machine 21, the sewing pattern can be added to "FAVORITE", as described later.

Figure 8:
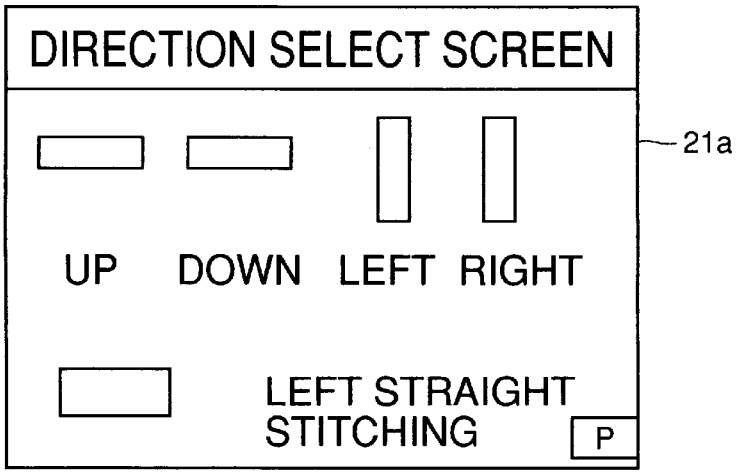

When selecting the sewing pattern through the A button 21*d* of the portable game machine 21 on the seam select screen shown in FIG. 7, a direction select screen is displayed as shown in FIG. 8. On this direction select screen, the direction of the seam is decided. The directions in this screen correspond to the cross key 21*b* of the portable game machine 21. For example, the upward arrow of the cross key 21*b* is pressed in order to select "UP" in the screen, or the leftward arrow of the cross key 21*b* is pressed in order to select "LEFT". The selected direction and the sewing pattern selected on the previous screen are displayed on the lower portion of the screen. After the selection, the direction is decided by pressing the A button 21*d* the portable game machine 21.

Figure 9:
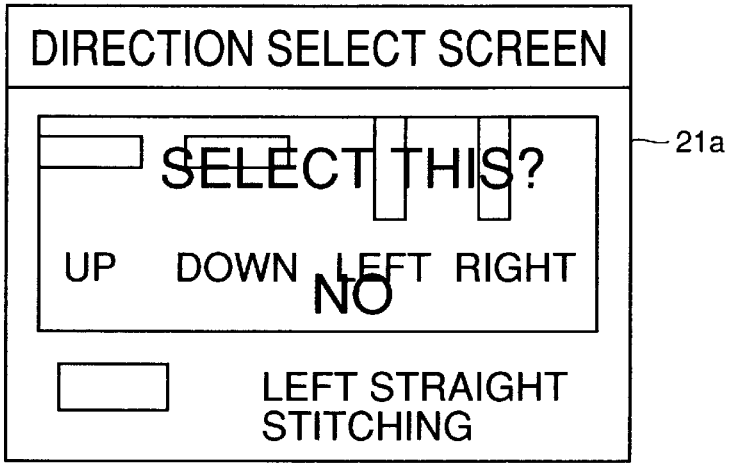

When the direction is decided on the direction select screen shown in FIG. 8, a confirm screen shown in FIG. 9 is displayed. The confirm screen is necessary for coping with false entry or the like. A next screen is displayed when "YES" is selected on the confirm screen for a message "SELECT THIS?", while the display returns to the previous screen when "NO" is selected.

Figure 10:
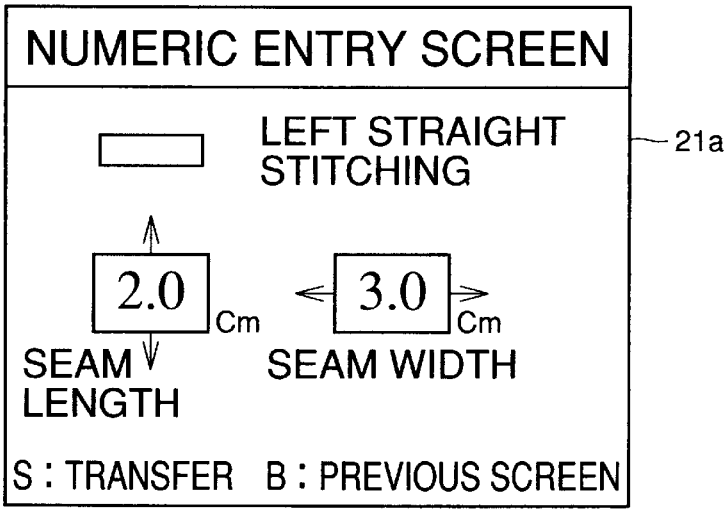

When "YES" is selected on the confirm screen shown in FIG. 9, a numeric entry screen shown in FIG. 10 is displayed. On this numeric entry screen, the seam length and the seam width are set through the cross key 21*b* (see FIG. 3 or 4) of the portable game machine 21. More specifically, the upward arrow of the cross key 21*b* is pressed in order to increase the seam length, while the downward arrow of the cross key 21*b* is pressed in order to reduce the seam length. The leftward arrow of the cross key 21*b* is pressed in order to increase the seam width, while the rightward arrow of the cross key 21*b* is pressed in order to reduce the seam width.

Figure 11:
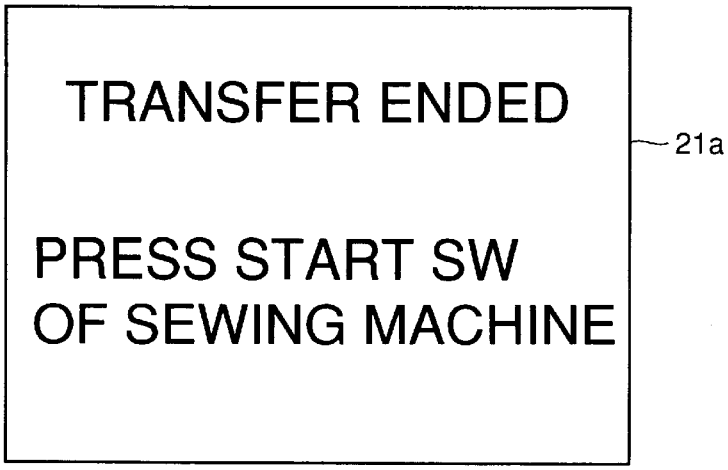
Figure 12:
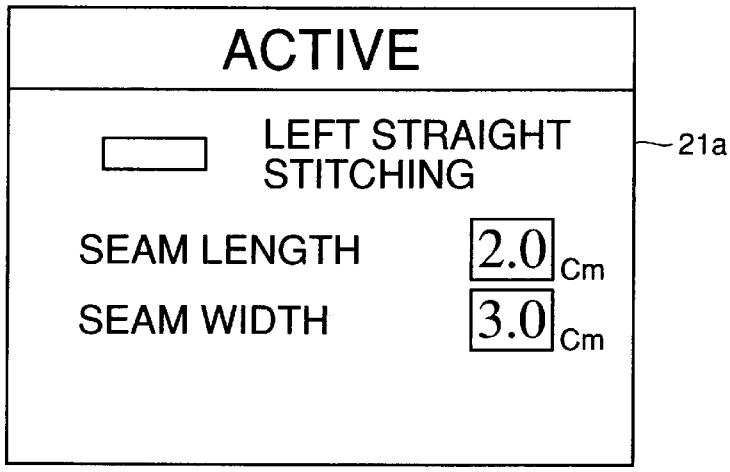

When the seam length and the seam width are completely set on the numeric entry screen shown in FIG. 10, data input is terminated. In this state, the S button 21*e* (see FIG. 3 or 4) of the portable game machine 21 is pressed so that the input data is transferred from the portable game machine 21 to the data signal input/output part 11*a* of the sewing machine body 1 through serial communication. When the data is completely transferred, a transfer end screen shown in FIG. 11 is displayed. A message "PRESS START SW OF SEWING MACHINE" is displayed on the transfer end screen. When the start switch 12*a* (see FIG. 3 or 4) provided on the outer surface of the sewing machine 1 is pressed in accordance with this instruction, the computer sewing machine starts left straight stitching. Then, a screen indicating the current state of the computer sewing machine is displayed as shown in FIG. 12.

Figure 13:
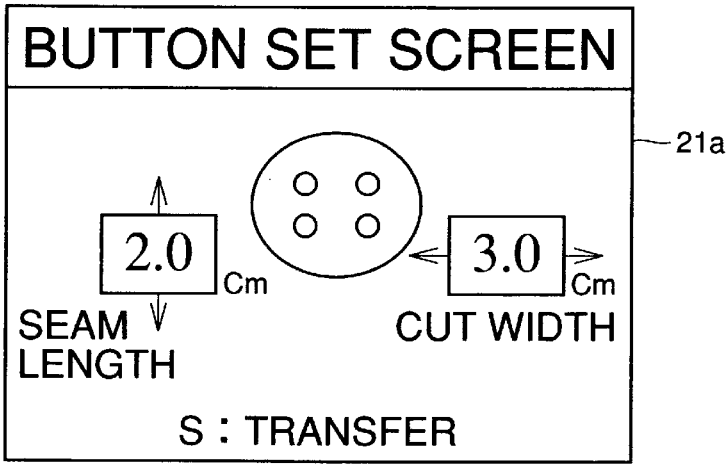

The case of selecting "BUTTONHOLE SEWING" on the initial screen shown in FIG. 6 is now described. When "BUTTONHOLE SEWING" is selected, a button set screen shown in FIG. 13 is displayed on the display panel 21*a* of the portable game machine 21. On this button set screen, the buttonhole type (two holes, four holes or the like) is selected through the A button 21*d*, while the seam length and the cut width of the buttonholes are set through the cross key 21*b* (see FIG. 3 or 4).

More specifically, the upward arrow of the cross key 21*b* is pressed in order to increase the seam length, while the downward arrow of the cross key 21 is pressed in order to reduce the seam length. Further, the leftward arrow of the cross key 21*b* is pressed in order to increase the cut width, while the rightward arrow of the cross key 21*b* is pressed in order to reduce the cut width. After the seam length and the cut width are completely set, the S button 21*e* of the portable game machine 21 is pressed so that the input data are transferred from the portable game machine 21 to the data signal input/output part 11*a* of the sewing machine body 1 through serial communication.

After the transfer is ended, the transfer end screen shown in FIG. 11 is displayed. The message "PRESS START SW OF SEWING MACHINE" is displayed on the transfer end screen. When the start switch 12*a* (see FIG. 3 or 4) provided on the outer surface of the sewing machine 1 is pressed in accordance with this instruction, the computer sewing machine starts buttonhole sewing. Then, the screen indicating the current state of the computer sewing machine is displayed as shown in FIG. 12.

Figure 14:
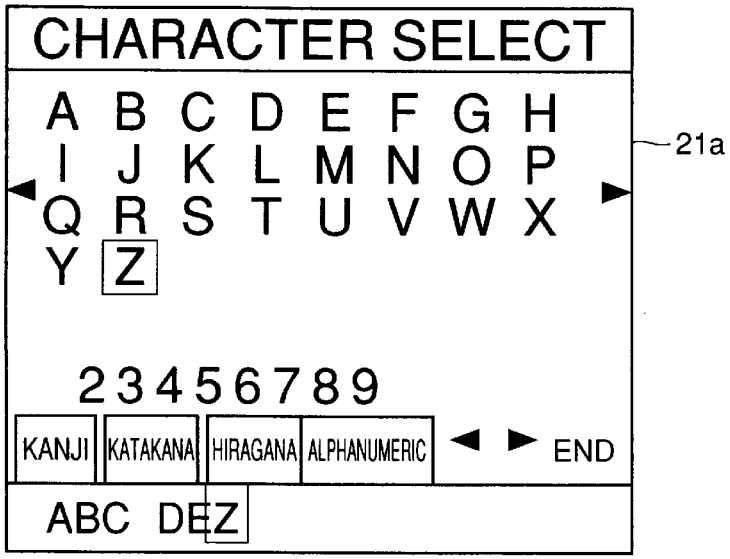

The case of selecting "CHARACTER SEWING" on the initial screen shown in FIG. 6 is now described. In order to select "CHARACTER SEWING", the embroiderer unit 3 must be attached to the sewing machine body 1 as in the second modification shown in FIG. 5, as described above. When "CHARACTER SEWING" is selected, a character select screen shown in FIG. 14 is displayed on the display panel 21*a* (see FIG. 5) of the portable game machine 21.

This character select screen is scrolled by pressing the leftward or rightward arrow of the cross key 21*b* (see FIG. 5), similarly to the seam select screen shown in FIG. 7. Referring to FIG. 14, the screen is in an alphanumeric mode. When positioning the cursor on a mark "KANJI", "HIRAGANA" or the like provided on the lower portion of the screen and pressing the A button 21*d* (see FIG. 5), the screen changes to that displaying the characters. The display "ABCDE" on the lowermost position indicates already input characters.

After "CHARACTER SEWING" is completely input, the S button 21*e* (see FIG. 5) of the portable game machine 21 is pressed so that the input data is transferred from the portable game machine 12 to the data signal input/output part 31*a* of the embroiderer unit 3 through the sewing machine body 1 through serial communication. When the transfer is ended, the transfer end screen shown in FIG. 11 is displayed. When the start switch 12*a* (see FIG. 5) provided on the outer surface of the sewing machine body 1 is pressed, the embroiderer unit 3 starts sewing the input embroidery pattern.

Figure 15:
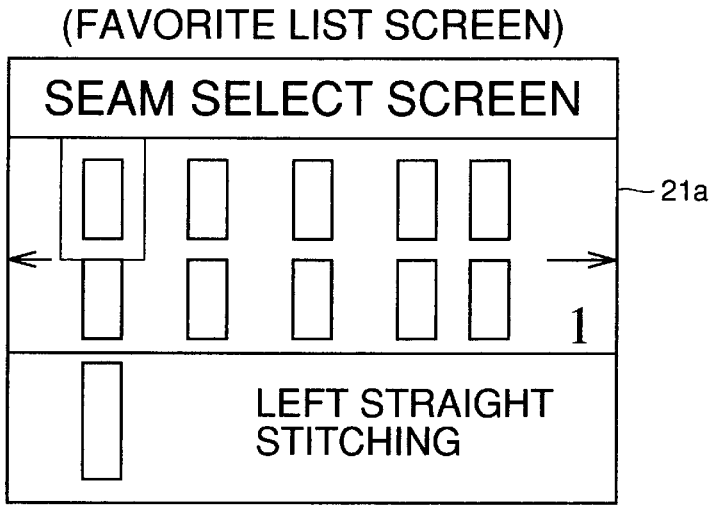

The case of selecting "FAVORITE" on the initial screen shown in FIG. 6 is now described. When "FAVORITE" is selected, a list of favorite seam patterns previously decided on the seam select screen is displayed on the display panel 21*a* of the portable game machine 21, as shown in FIG. 15. On this screen, a favorite seam pattern can be selected and decided by pressing the A button 21*d*, while the selected seam can be deleted from the list by pressing the B button 21*c*. A confirm screen (not shown) is displayed on either case. When the A button 21*d* is pressed for the favorite seam pattern, the direction select screen shown in FIG. 8 is displayed so that data are sequentially input along the aforementioned screens shown in FIGS. 8 to 10 and thereafter transferred.

Figure 16:
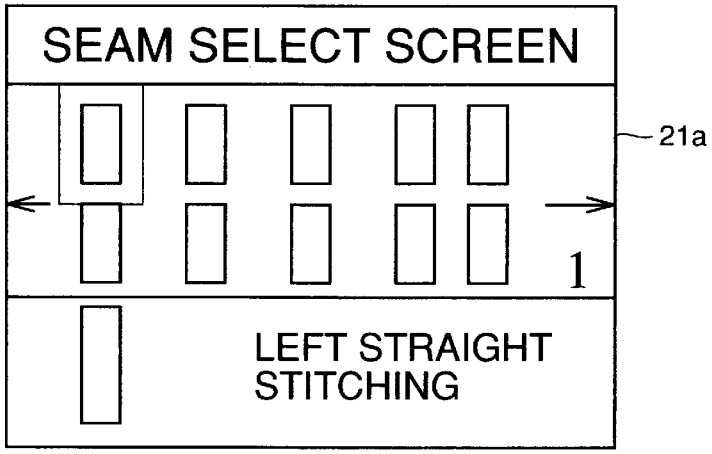
Figure 17:
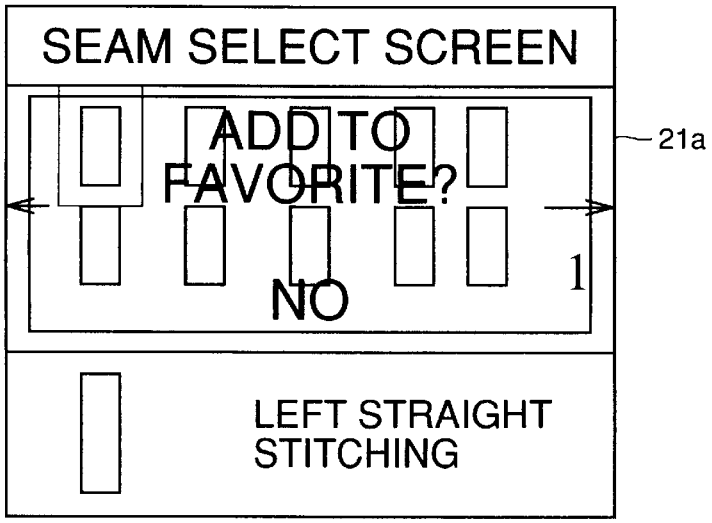

The item "FAVORITE" can be added to or deleted from the seam select screen shown in FIG. 7. In order to add left straight stitching, for example, the cursor is positioned on "LEFT STRAIGHT STITCHING" as shown in FIG. 16 and the B button 21*c* is pressed. In this case, a confirm screen shown in FIG. 17 is displayed so that "LEFT STRAIGHT STITCHING" is added to "FAVORITE" when "YES" is selected for a message "ADD TO FAVORITE?".

If "LEFT STRAIGHT STITCHING" has already been selected as "FAVORITE", a message "DELETE FROM FAVORITE?" appears so that "LEFT STRAIGHT STITCHING" is deleted from "FAVORITE" when "YES" is selected. When "NO" is selected, on the other hand, the display returns to the seam select screen.

Figure 18:
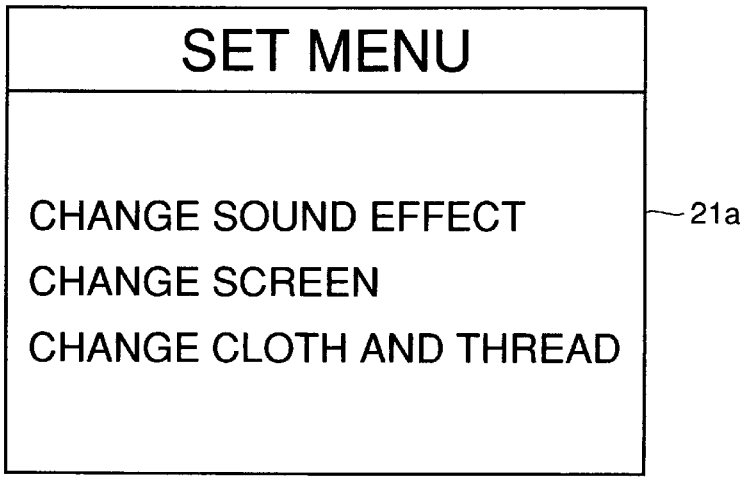

The case of selecting "SET" on the initial screen shown in FIG. 6 is now described. When "SET" is selected, a set screen shown in FIG. 18 is displayed on the display panel 21*a* of the portable game machine 21. On this set screen, "CHANGE SOUND EFFECT", "CHANGE SCREEN" or "CHANGE CLOTH AND THREAD" can be set.

Figure 19:
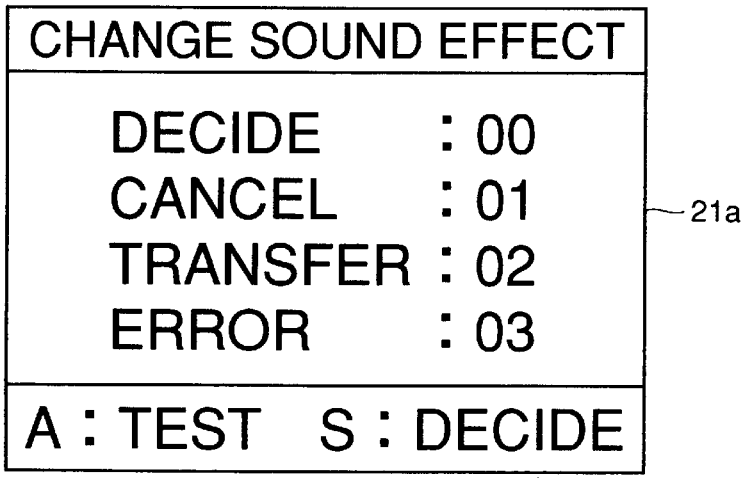

When "CHANGE SOUND EFFECT" is selected on the set screen shown in FIG. 18, a screen for changing sound effect shown in FIG. 19 is displayed. On this screen, various sounds can be produced by changing the number corresponding to each sound. A selected sound is played on trial when the A button 21*d* is pressed, and the selected sound is decided when the S button 21*e* is pressed. When the B button 21*c* is pressed, the sound effect automatically returns to a default sound.

Figure 20:
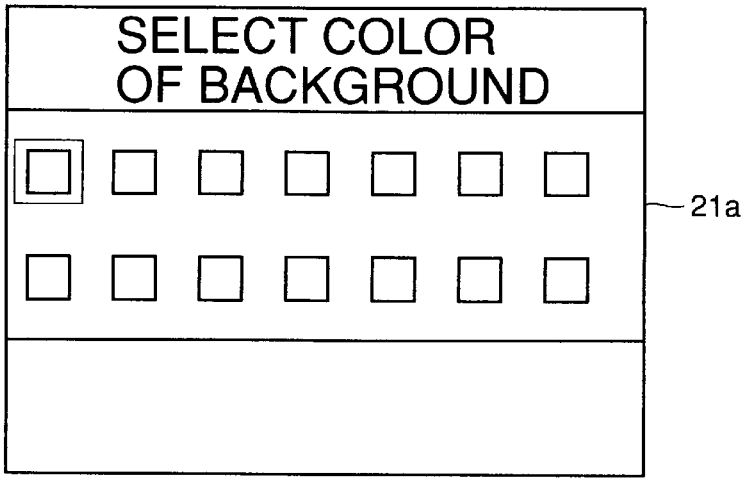

When "CHANGE SCREEN" is selected on the set screen shown in FIG. 18, a screen shown in FIG. 20 is displayed. On this screen, the color of the background, the color of the frame and the color of the characters can be changed. First, an item to be changed is selected from "COLOR OF BACKGROUND", "COLOR OF FRAME" and "COLOR OF CHARACTER". For example, the item "COLOR OF SCREEN" is selected and an arbitrary color is selected from those displayed on the screen. The selected color is immediately reflected on the screen of the display panel 21*a* of the portable game machine 21. Also in this case, the screen automatically returns to a default color when the B button 21*c* is pressed.

Figure 21:
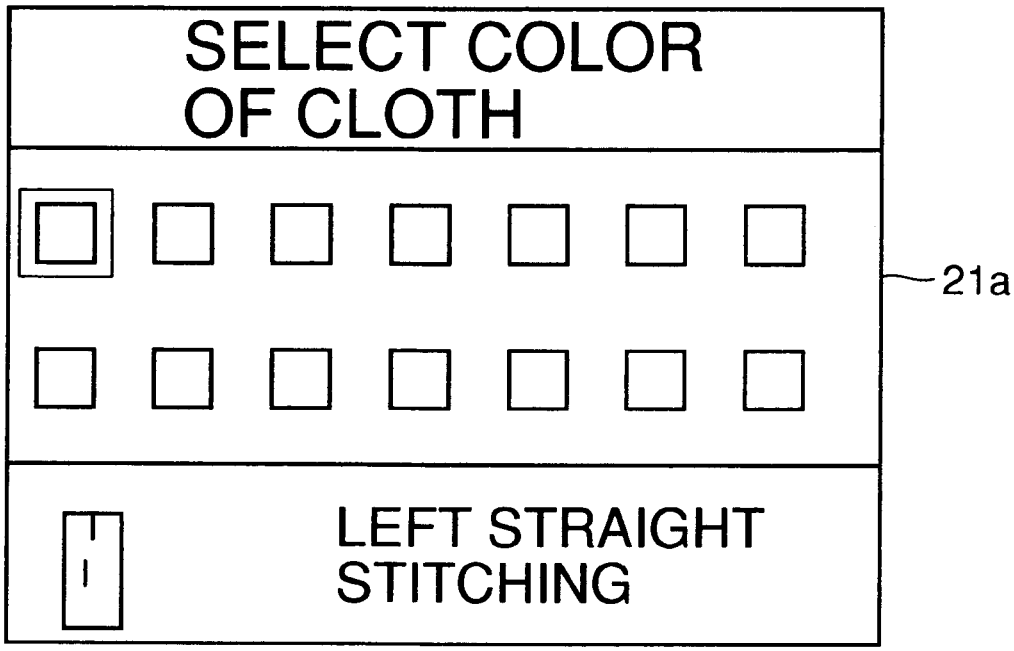

When "CHANGE CLOTH AND THREAD" is selected on the set screen shown in FIG. 18, a screen shown in FIG. 21 is displayed. On this screen, the color of the cloth is selected first, followed by selection of the color of the threads.

Figure 22:
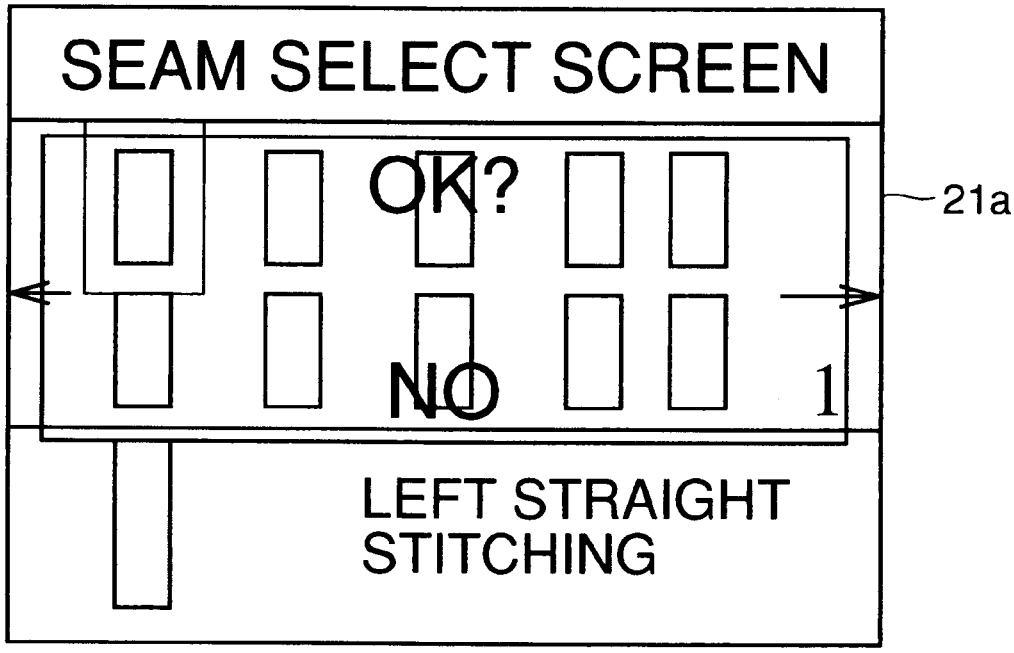

The selected colors are reflected on a sample on the lower left portion of the screen. After the colors of the cloth and the threads are completely selected, a confirm screen "OK?" is displayed as shown in FIG. 22. The display returns to the seam select screen when "YES" is selected. In order to re-select the colors, "NO" is selected. In this case, the colors of the cloth and the threads can be re-selected.

(Second Embodiment)

Figure 23:
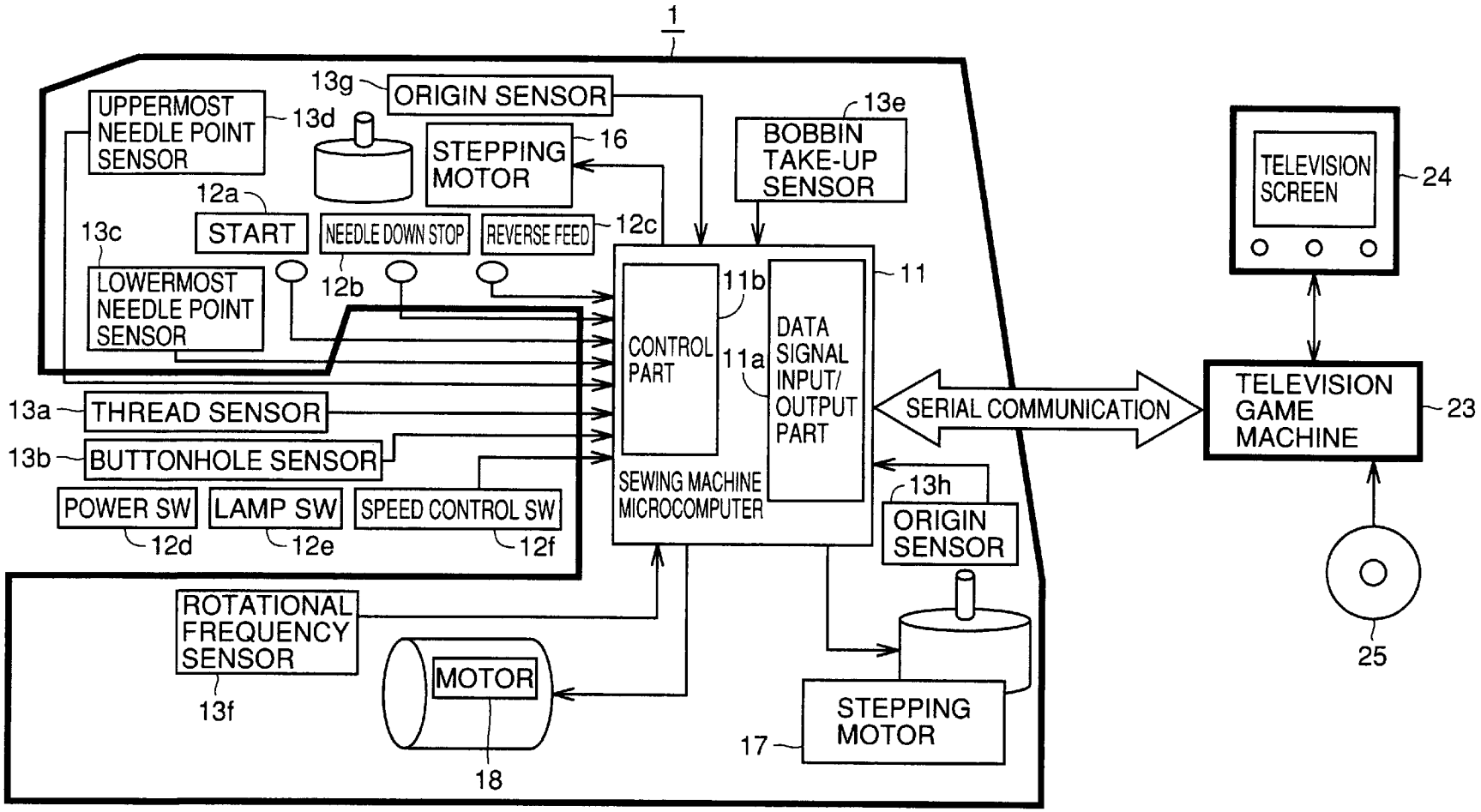
FIG. 23 is a schematic diagram showing the structure of a computer sewing machine according to a second embodiment of the present invention.

Referring to FIG. 23, the structure of a sewing machine body 1 of a computer sewing machine according to a second embodiment of the present invention is identical to that of the sewing machine 1 of the computer sewing machine according to the first embodiment shown in FIG. 3. In the second embodiment, however, a television game machine 23 is employed as a data input/output unit, dissimilarly to the first embodiment. The television game machine 23 utilizes the screen of a television 24 as a display panel. In this case, serial data communication is made between a data signal input/output part 11*a* of the sewing machine body 1 and the television game machine 23.

In the second embodiment, the television game machine 23 includes a CD-ROM 25 as a storage medium storing a program for operating the sewing machine body 1. The CD-ROM 25 is set on the television game machine 23, so that the television game machine 23 can be readily utilized as the data input/output unit of the computer sewing machine.

According to the second embodiment, the television game machine 23 is employed as the data input/output unit, whereby no data input/output unit dedicated to the sewing machine need be separately purchased while the sewing machine body 1 need not be provided with the high-priced liquid crystal touch panel 119 (see FIG. 27), dissimilarly to the prior art. Thus, the cost for manufacturing the sewing machine body 1 can be reduced and a high-functional computer sewing machine can be consequently provided at a low cost.

Figure 24:
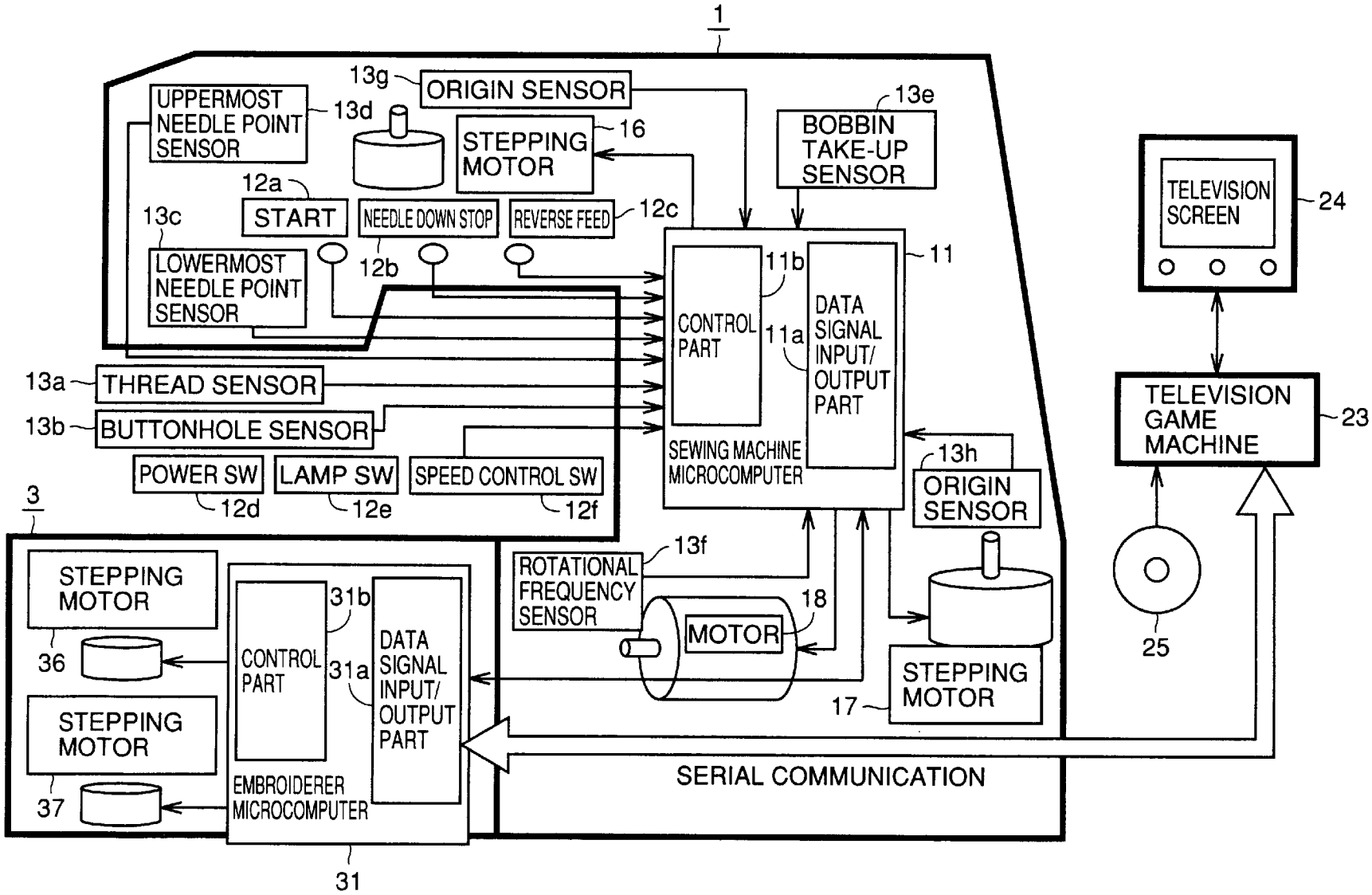
FIG. 24 is a schematic diagram showing the structure of a first modification of the computer sewing machine according to the second embodiment.

FIG. 24 is a schematic diagram showing the structure of a first modification of the computer sewing machine according to the second embodiment. Referring to FIG. 24, an embroiderer unit 3 is detachably set on a sewing machine body 1 in the structure of the second embodiment shown in FIG. 23. In this case, serial communication is made between a data signal input/output part 31*a* of the embroiderer unit 3 and a television game machine 23. The sewing machine body 1 and the embroiderer unit 3 in the first modification of the second embodiment are identical in structure to those of the second modification of the first embodiment shown in FIG. 5.

(Third Embodiment)

Referring to FIG. 3, a sewing machine body 1 of a computer sewing machine according to a third embodiment of the present invention is identical in structure to the sewing machine body 1 of the computer sewing machine according to the first embodiment shown in FIG. 3. In the third embodiment, however, a personal computer 26 having a display 26*a* is employed as a data input/output unit, dissimilarly to the first and second embodiments. In this case, serial data communication is made between a data signal input/output part 11*a* of the sewing machine body 1 and the personal computer 26 through RS232C or the like.

In the third embodiment, the personal computer 26 includes a CD-ROM 27 or a disk 28 as a storage medium storing a program for operating the sewing machine body 1. The CD-ROM 27 or the disk 28 is set on the personal computer 26, so that the personal computer 26 can be readily utilized as the data input/output unit of the computer sewing machine.

According to the third embodiment, the personal computer 26 is employed as the data input/output unit so that an embroidery pattern created in the personal computer 26 or a pattern downloaded in the personal computer 26 through Internet can be transferred to the sewing machine body 1 through RS232C or the like. Thus, a pattern other than previously stored ones can be readily sewn or embroidered with no requirement for the data writing unit 121 (see FIG. 27) dedicated to the sewing machine, dissimilarly to the prior art.

External input equipment 29 such as a scanner or a digitizer is connected with the personal computer 26 as general peripheral equipment. In this case, a sewing pattern described on a prescribed pattern can be loaded in the personal computer 26 with the external input equipment 29 such as a scanner so that the loaded sewing pattern data is transferred to the sewing machine body 1 through RS232C or the like. In this case, the external equipment 29 is employed as general peripheral equipment for the personal computer 26, whereby the data writing unit 121 (see FIG. 27) dedicated to the sewing machine is not required dissimilarly to the prior art.

When the personal computer 26 is employed as the data input/output unit, no data input/output unit dedicated to the sewing machine need be separately purchased while the sewing machine body 1 need not be provided with the high-priced liquid crystal touch panel (see FIG. 27) dissimilarly to the prior art. Thus, the cost for manufacturing the sewing machine body 1 can be reduced, and a high-functional computer sewing machine can be consequently provided at a low cost.

Figure 25:
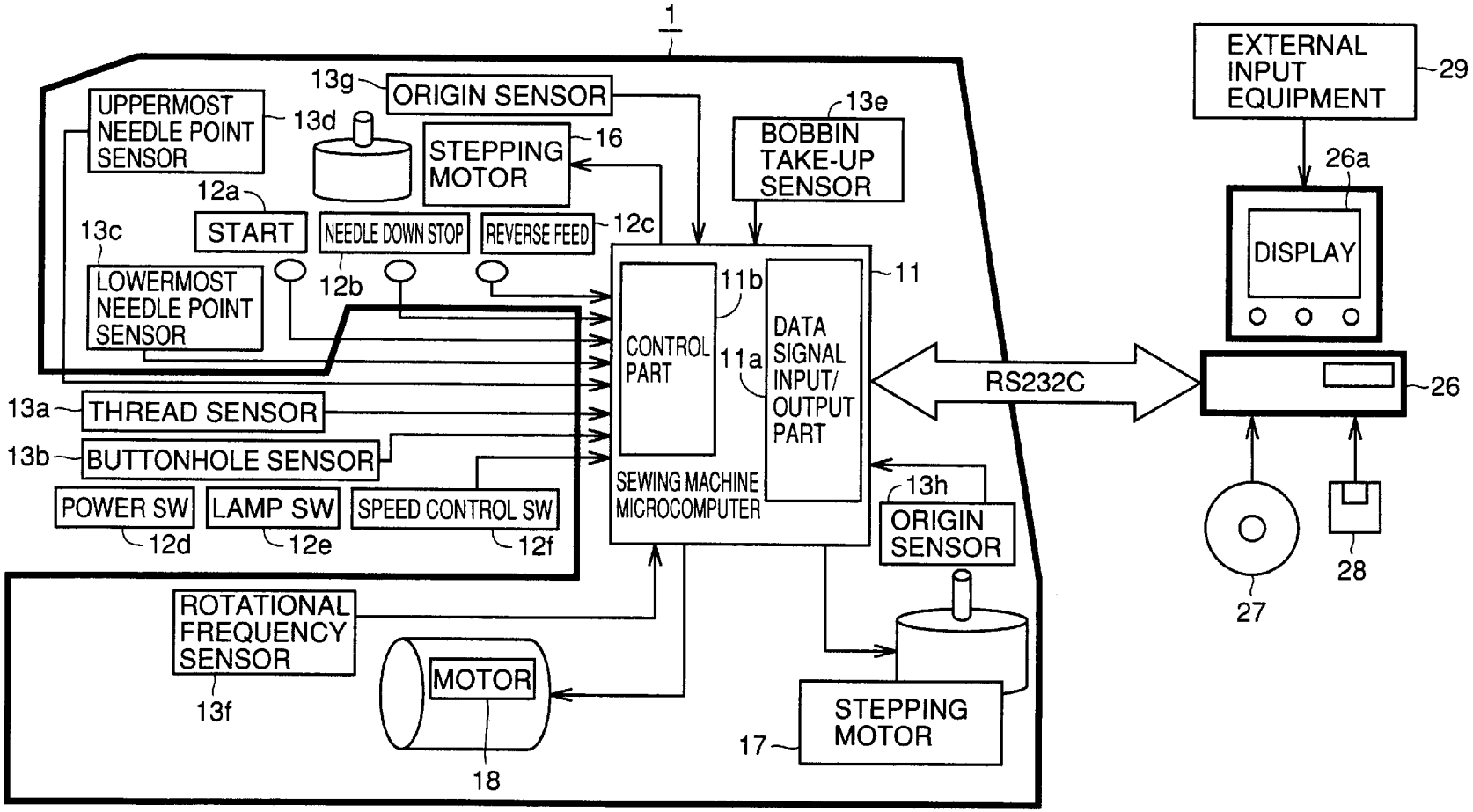
FIG. 25 is a schematic diagram showing the structure of a computer sewing machine according to a third embodiment of the present invention.
Figure 26:
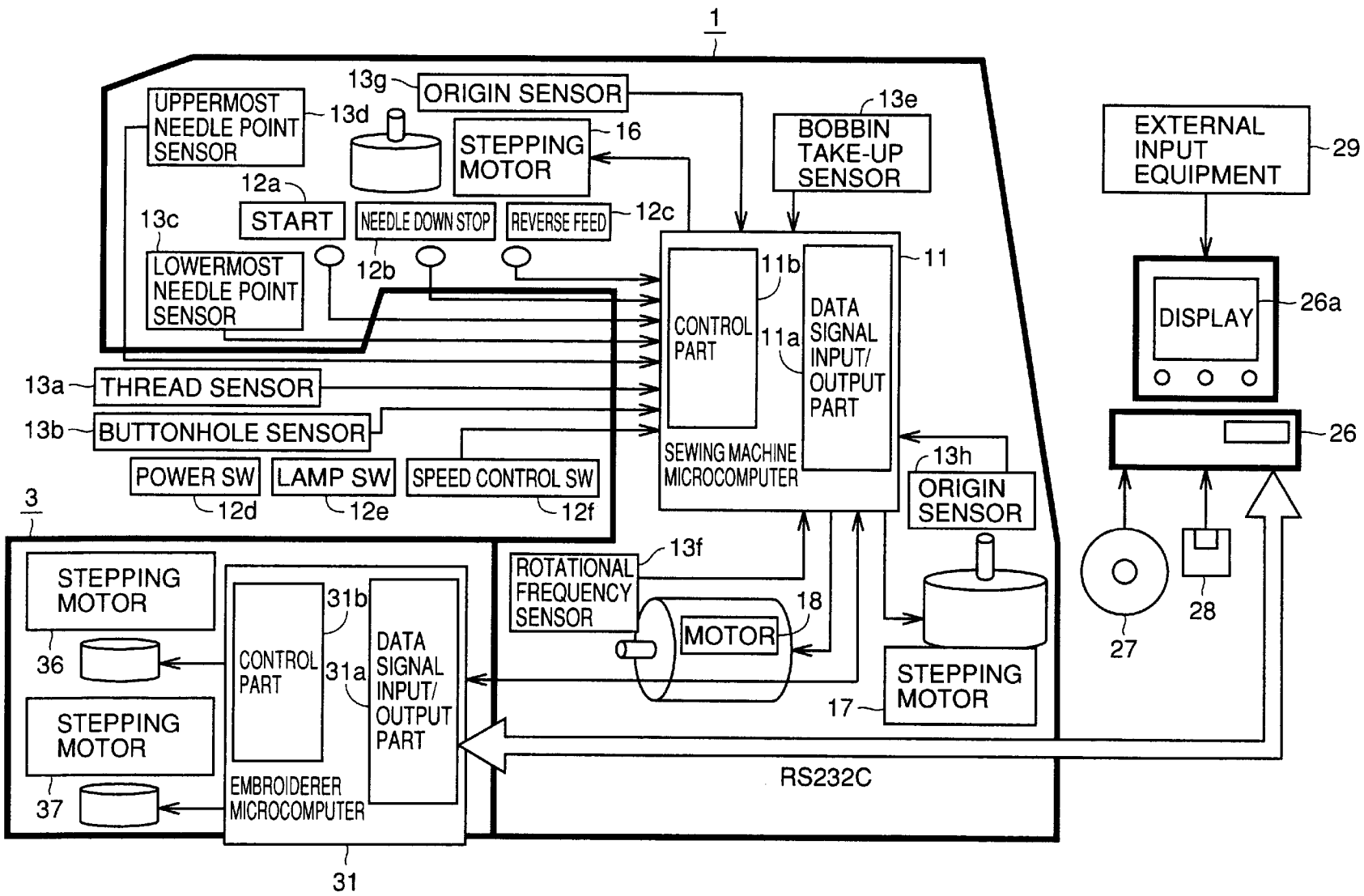
FIG. 26 is a schematic diagram showing the structure of a first modification of the computer sewing machine according to the third embodiment.

FIG. 26 is a schematic diagram showing the structure of a first modification of the computer sewing machine according to the third embodiment. Referring to FIG. 26, an embroiderer unit 3 is further detachably set on a sewing machine body 1, in the structure of the third embodiment shown in FIG. 25. In this case, serial data communication is made between a data signal input/output part 31*a* of the embroiderer unit 3 and a personal computer 26 through RS232C or the like. The sewing machine body 1 and the embroiderer unit 3 according to the first modification of the third embodiment are identical in structure to those of the second modification of the first embodiment shown in FIG. 5.

Although the present invention has been described and illustrated in detail, it is clearly understood that the same is by way of illustration and example only and is not to be taken by way of limitation, the spirit and scope of the present invention being limited only by the terms of the appended claims. While serial communication through RS232C or the like is employed in the first to third embodiments as a method of transmitting/receiving data, for example, the present invention is not restricted to this but a similar effect can be attained by employing communication through a transmission line other than serial communication, radio communication or optical communication through infrared light or the like.

What is claimed is:

1. A computer sewing machine comprising:

a data signal input/output part for transmitting/receiving a data signal to/from an externally set data input/output unit through data communication employing any of a transmission line, radio and light; and a control part controlling the operation of a sewing machine body on the basis of said data signal from said data input/output unit received in said data signal input/output part; wherein said data input/output unit includes a portable game machine integrally formed with an operation part and a display panel, wherein the portable game machine does not have a keyboard and a mouse and does have a control button.

2. The computer sewing machine in accordance with claim 1, wherein said sewing machine body includes an embroiderer unit, attachable/detachable to/from said sewing machine body, for performing embroidering.

3. The computer sewing machine in accordance with claim 1, wherein said sewing machine body includes a game machine mounting part for mounting said portable game machine.

4. A computer sewing machine comprising:

a data signal input/output part for transmitting/receiving a data signal to/from an externally set data input/output unit through data communication employing any of a transmission line, radio and light; and a control part controlling the operation of a sewing machine body on the basis of said data signal from said data input/output unit received in said data signal input/output part;

wherein said data input/output unit includes a television game machine employing the screen of a television as a display panel.

5. The computer sewing machine in accordance with claim 4, wherein said television game machine includes a storage medium storing a program for operating said sewing machine body.

6. The computer sewing machine in accordance with claim 4, wherein said sewing machine body includes an embroiderer unit, attachable/detachable to/from said sewing machine body, for performing embroidering.

7. A method of controlling a computer sewing machine, comprising steps of:

inputting operation data for a sewing machine body in an externally set data input/output unit;

transmitting said input operation data from said data input/output unit to said sewing machine body by data communication employing any of a transmission line, radio and light; and controlling the operation of said sewing machine body on the basis of said operation data transmitted to said sewing machine body; wherein said data input/output unit includes a portable game machine integrally formed with an operation part and a display panel, wherein the portable game machine does not have a keyboard and a mouse and does have a control button.

* * * * *